US010329969B2

(12) United States Patent
Simpson et al.

(10) Patent No.: US 10,329,969 B2
(45) Date of Patent: Jun. 25, 2019

(54) SYSTEM AND METHOD OF ADJUSTING ACTUATION TIMING OF VALVES IN A PISTON ENGINE

(71) Applicant: Jacobs Vehicle Systems, Inc., Bloomfield, CT (US)

(72) Inventors: Roger T. Simpson, Ithaca, NY (US); Jacob M. Moore, Cromwell, CT (US); Alan Steines, Madison, CT (US); John A. Schwoerer, Storrs Mansfield, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 13 days.

(21) Appl. No.: 15/522,529

(22) PCT Filed: Oct. 23, 2015

(86) PCT No.: PCT/US2015/057038

§ 371 (c)(1),
(2) Date: Apr. 27, 2017

(87) PCT Pub. No.: WO2016/077053

PCT Pub. Date: May 19, 2016

(65) Prior Publication Data

US 2017/0335727 A1 Nov. 23, 2017

Related U.S. Application Data

(60) Provisional application No. 62/077,686, filed on Nov. 10, 2014.

(51) Int. Cl.
*F01L 9/02* (2006.01)
*F01L 9/04* (2006.01)

(52) U.S. Cl.
CPC ..... *F01L 9/025* (2013.01); *F01L 9/02* (2013.01); *F01L 9/021* (2013.01); *F01L 9/023* (2013.01);
(Continued)

(58) Field of Classification Search
CPC ..... F01L 9/02; F01L 2009/0467; F01L 9/021; F01L 9/023; F01L 9/025
(Continued)

(56) References Cited

U.S. PATENT DOCUMENTS 8,985,074 B2 * 3/2015 Zurface ..... F01L 1/18 123/90.16
2003/0183183 A1 10/2003 Yamaki et al.
(Continued)

OTHER PUBLICATIONS

Zurface et al., System to Diagnose Variable Valve Actuation Malfunctions by Monitoring Fluid Pressure in a Hydraulic Lash Adjuster Gallery, US Patent Application, Pub. No. US 2013/0233265, Sep. 12, 2013.*

(Continued)

*Primary Examiner* — Ching Chang
(74) *Attorney, Agent, or Firm* — Moreno IP Law LLC

(57) ABSTRACT

A system that provides adjustable actuation timing of one or more valve(s) (16) in a piston engine includes a position sensor (12) and a variable valve actuation assembly (10). The valve(s) (16) can be intake and/or exhaust valves in an internal combustion engine of an automobile. The position sensor (12) takes position readings of the valve(s) (16) as the valve(s) (16) actuate in the piston engine. The variable valve actuation assembly (10) controls actuation timing of the valve(s) (16). Actuation timing of the valve(s) (16) is adjustable based, in part or more, upon one or more position reading(s) of the position sensor (12). The variable valve actuation assembly (10) can be a lost motion assembly (10).

14 Claims, 2 Drawing Sheets

(52) U.S. Cl.
CPC ..... *F01L 9/04* (2013.01); *F01L 2009/0467* (2013.01)

(58) Field of Classification Search
USPC ..... 123/90.12, 90.13
See application file for complete search history.

(56) References Cited

U.S. PATENT DOCUMENTS

| | | | |
|---|---|---|---|
| 2007/0272179 | A1 | 11/2007 | Luercho |
| 2011/0162602 | A1 | 7/2011 | Smith |
| 2013/0085654 | A1 | 4/2013 | Yamamoto et al. |
| 2013/0306013 | A1 | 11/2013 | Zurface et al. |

OTHER PUBLICATIONS

International Search Report and Written Opinion of the International Searching Authority in PCT/US2015/057038 dated Jan. 25, 2016.

* cited by examiner

SYSTEM AND METHOD OF ADJUSTING ACTUATION TIMING OF VALVES IN A PISTON ENGINE

This application claims the benefit of U.S. Provisional Ser. No. 62/077,686 filed on Nov. 10, 2014, the entire contents of which are hereby incorporated by reference.

TECHNICAL FIELD

The present disclosure generally relates to variable valve actuation assemblies for piston engines, and more particularly relates to making adjustments to the actuation timing of valves in piston engines.

BACKGROUND

Variable valve actuation (VVA) assemblies are commonly equipped in piston engines such as automotive internal combustion engines, and are used for controlling actuation timing of valves in the engines. The actuation timing involves opening and closing intake and exhaust valves. Intake valves admit air or air-fuel mixture into engine cylinders, and exhaust valves let exhaust gasses out of the cylinders. In general, the VVA assemblies can help improve fuel economy, reduce exhaust emissions, and enhance engine performance in the associated automobiles. An engine typically includes more than one VVA assembly—for instance, a single VVA assembly at each cylinder of the engine. And each VVA assembly typically includes any number of mechanical components, electrical components, hydraulic components, or pneumatic components.

In one embodiment, a system that provides adjustable actuation timing of one or more valve(s) in a piston engine includes a position sensor and a variable valve actuation assembly. The position sensor takes position readings of the valve as the valve actuates in the piston engine. The variable valve actuation assembly is equipped at the valve and controls actuation timing of the valve. Actuation timing of the valve can be adjusted based, in part or more, upon one or more position reading(s) of the valve taken by the position sensor.

SUMMARY

In one embodiment, a system that provides adjustable actuation timing of one or more valve(s) in a piston engine includes a position sensor and a variable valve actuation assembly. The position sensor takes position readings of the valve as the valve actuates in the piston engine. The variable valve actuation assembly is equipped to the valve and controls actuation timing of the valve. Actuation timing of the valve can be adjusted based, in part or more, upon one or more position reading(s) of the valve taken by the position sensor.

In another embodiment, a method of adjusting actuation timing of one or more valve(s) in a piston engine by way of one or more variable valve actuation assembly(ies) includes several steps. One step involves taking a first position reading of the valve in the piston engine when the valve is at a closed position. Another step involves taking a second position reading of the valve when the valve is at a fully open position. Another step involves using the first and second position readings to calibrate subsequent position readings of the valve. Yet another step involves taking a third position reading of the valve before slowdown occurs adjacent the closed position. Yet another step involves referencing the third position reading to a predefined position of the valve. And yet another step involves making adjustments to the actuation timing of the valve, if called for, based in part or more upon the third position reading being referenced to the predefined position.

In yet another embodiment, a system that provides adjustable actuation timing of valves in a piston engine includes a first position sensor, a first lost motion assembly, a second position sensor, a second lost motion assembly, and an electronic control unit. The first position sensor is located near a first valve of a first cylinder of the piston engine. The first lost motion assembly actuates the first valve, and includes a first master piston, a first slave piston, and a first solenoid valve. The second position sensor is located near a second valve of a second cylinder of the piston engine. The second lost motion assembly actuates the second valve, and includes a second master piston, a second slave piston, and a second solenoid valve. The electronic control unit receives a first position reading from the first position sensor of the first valve before slowdown occurs adjacent a closed position. The first position reading is referenced to a first predefined position. Actuation timing of the first valve via activation and deactivation of the first solenoid valve can be adjusted based, in part or more, upon the first position reading being referenced to the first predefined position. The electronic control unit receives a second position reading from the second position sensor of the second valve before slowdown occurs adjacent a closed position. The second position reading is referenced to a second predefined position. Actuation timing of the second valve via activation and deactivation of the second solenoid valve can be adjusted based, in part or more, upon the second position reading being referenced to the second predefined position.

DETAILED DESCRIPTION

The figures illustrate an embodiment of a system and method that provide adjustable actuation timing of valves in a piston engine. The actuation timing can involve opening and closing intake and exhaust valves in an internal combustion engine of an automobile. While described in greater detail below, in general, the system and method make needed adjustments to actuation timing in order to account for performance variations among variable valve actuation assemblies in the piston engine, and to account for performance variations among variable valve actuation assemblies between piston engines of the same kind. A position sensor is employed, and its position readings are used as a basis for any adjustments. The system and method bring greater precision and better reliability and consistency to valve actuation timing in piston engines and help ensure improved fuel economy, reduced exhaust emissions, and overall enhanced engine performance in the associated automobiles.

Further, the system and method can be used for monitoring the functionality of variable valve actuation assemblies and observe any malfunctions.

Figure 1:
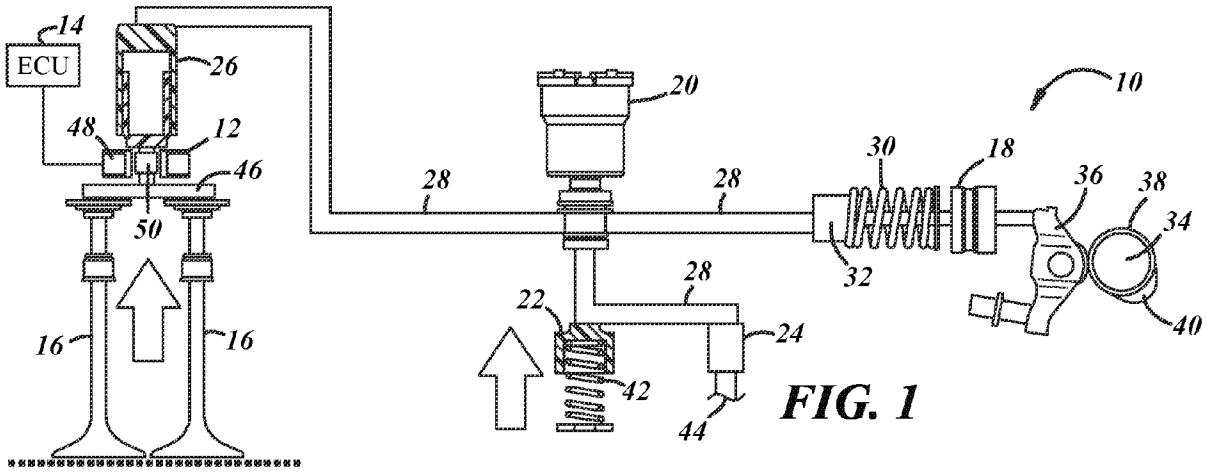
FIG. 1 is a schematic of an embodiment of a variable valve actuation assembly with an embodiment of a position sensor.
Figure 2:
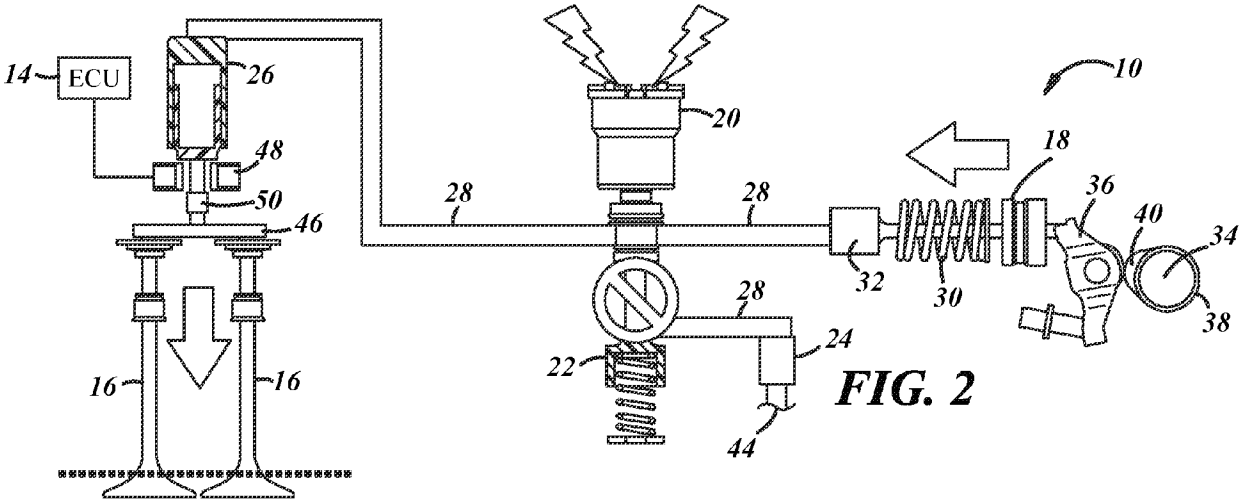
FIG. 2 is another schematic of the variable valve actuation assembly and position sensor of FIG. 1.

The system can have different designs, constructions, and components depending on—among other potential determinants—the architecture of the associated piston engine and the architecture of the associated valvetrain. In the embodiment presented by FIGS. 1 and 2, the system includes a variable valve actuation (VVA) assembly 10, a position sensor 12, and an electronic control unit (ECU) 14. In general, VVA assemblies control actuation timing and advance or retard opening and closing movements of intake and exhaust valves. The exact actuation timing is ordinarily controlled according to an engine performance strategy set by the automobile manufacturer. A piston engine can sometimes be equipped with one or more VVA assemblies at each of its cylinders for independent control of the valves at the cylinders. And like the larger system, VVA assemblies can have different designs, constructions, and components depending upon engine and valvetrain architecture. Variable valve actuation assemblies can include any number of mechanical components, electrical components, hydraulic components, or pneumatic components. In FIGS. 1 and 2, the VVA assembly 10 is a lost motion assembly. Types of VVA assemblies include electro-mechanical actuation assemblies, electro-magnetic actuation assemblies, electro-hydraulic actuation assemblies, and pneumatic actuation assemblies.

The lost motion assembly 10 actuates the opening and closing movements of valves 16 in a cylinder of the associated piston engine. The valves 16 can be intake or exhaust valves. In the example of FIGS. 1 and 2, the lost motion assembly 10 includes a master piston 18, a solenoid valve 20, an accumulator 22, a check valve 24, a slave piston 26, and a fluid-flow circuit 28. The master piston 18 has a spring 30 and a push rod 32 that reciprocates in response to engagement by a cam 34 of an engine camshaft. The cam 34 directly impinges a rocker arm 36, which in turn impinges the master piston 18. The cam 34 has a base 38 and a lobe 40. The solenoid valve 20 is commanded to activate and deactivate in order to regulate fluid-flow in the fluid-flow circuit 28. When activated, the solenoid valve 20 is brought to an open state and permits fluid-flow; and when deactivated, the solenoid valve 20 is brought to a closed state and prevents fluid-flow. The solenoid valve 20 could be normally-opened or normally-closed. The accumulator 22 stores pressurized fluid in a reservoir via a spring 42. The check valve 24 opens to permit fluid-flow from a supply 44, which can be fed fluid from a pump. Other components of the lost motion assembly 10 prompt the slave piston 26 to reciprocate a bridge 46 outward and inward to open and close the valves 16. A valve catch in the slave piston 26 slows-down the closing movement of the valves 16 as the valves 16 are about to be seated in their fully closed position. Lastly, the fluid-flow circuit 28 fluidly communicates the components of the lost motion assembly 10 via a hydraulic fluid. Still, the lost motion assembly 10 can have more, less, and/or different components than those depicted in the figures and described here.

The position sensor 12 senses the position and movement of the valves 16 as the valves 16 open and close, and sends the corresponding position readings as input to the ECU 14. In the associated piston engine there can be multiple position sensors, the exact number of which may depend on the number of valves and on the number of cylinders in the engine. However many there are, an individual position sensor 12 can be located at the valves 16, at the slave piston 26, at the bridge 46, or at another location where the position sensor 12 can properly sense the position and movement of the valves 16. Its exact location may be dictated by the type of position sensor and the valvetrain architecture. Referring again to the example of FIGS. 1 and 2, the position sensor 12 is mounted on a rod of the slave piston 26 near the bridge 46. The position sensor 12 may be of different types, and one type is a variable inductance position sensor. In general, variable inductance position sensors are made up of a coil 48 and a metal target 50. As the metal target 50 moves relative to the coil 48, the frequency of the related circuit changes in proportion to the movement. The change in frequency can be converted into an appropriate signal for the ECU 14, and can be related to corresponding valve positions. These types of valves and their operations and the attendant computations will be known to skilled artisans. Still, another type of position sensor is a variable reluctance position sensor.

The ECU 14 electrically communicates with the position sensor 12 and receives input from the position sensor 12 in the form of position readings. The ECU 14 may manage the functionality of the lost motion assembly 10, and hence may command the activation and deactivation of the solenoid valve 20. There could be a single ECU 14 that electrically communicates with all of the VVA assemblies 10 in the associated piston engine, or there may be multiple ECUs 14 electrically communicating with individual VVA assemblies 10. Further, the ECU 14 could be part of another ECU in the associated automobile or could itself constitute another automobile ECU. Or the ECU 14 could electrically communicate with another automobile ECU such as an engine ECU. Whatever the arrangement, the ECU 14 can perform one or more of the method steps described below with reference to FIG. 3. The method steps can be implemented in a computer program product, like the ECU 14, with instructions carried on a computer readable medium. The ECU 14 may include software programs with instructions in source code, object code, executable code, or some other format; may include firmware programs; may include hardware description language (HDL) files; and may include any program related data. The data may involve data structures, look-up tables, or data in any other suitable format. And the instructions may involve modules, routines, objects, components, and/or the like.

The system and method detailed in this description make needed adjustments to the actuation timing of the valves 16 in order to reconcile performance variations of individual VVA assemblies 10 in the associated piston engine, and to reconcile performance variations among multiple VVA assemblies 10 in multiple piston engines. It has been observed that differences among components in the VVA assemblies 10 can result in appreciable performance variations—for instance, actuation timing in an individual VVA assembly 10 can be off by as much eight crank angle degrees (8°) from its expected and predefined timing, and can be off by as much as sixteen crank angle degrees (16°) between a pair of VVA assemblies 10 in a piston engine. Other variation magnitudes are of course possible. The differences are found in components of the VVA assemblies 10, such as mechanical, electrical, hydraulic, or pneumatic components, depending on the particular type of VVA assembly. The differences can involve imprecisely manufactured and imprecisely installed components, manufacturing tolerances, wear on components over the lifetime of their use, slower response rates for electrical components, and fluid leakages in hydraulic and pneumatic components. In the example of the lost motion assembly 10 of the figures, these differences can present themselves via slower activation and deactivation response rates of the solenoid valve 20, leakage somewhere in the fluid-flow circuit 28, and even viscosity fluctuations of the hydraulic fluid in the fluid-flow circuit 28 as temperatures increase and decrease. Still, differences can arise in other ways.

Once the performance variations are reconciled, the system and method bring greater precision and better consistency to the actuation timing of the valves 16, and hence improve fuel economy, reduce exhaust emissions, and enhance overall engine performance in the associated automobiles. And because greater precision is effectuated with the system and method, other components of the VVA assemblies 10 may themselves have less precision and may therefore be less costly to produce. For instance, in the example of the lost motion assembly 10, the solenoid valve 20 may not necessarily activate and deactivate with higher levels of exactitude.

Figure 3:
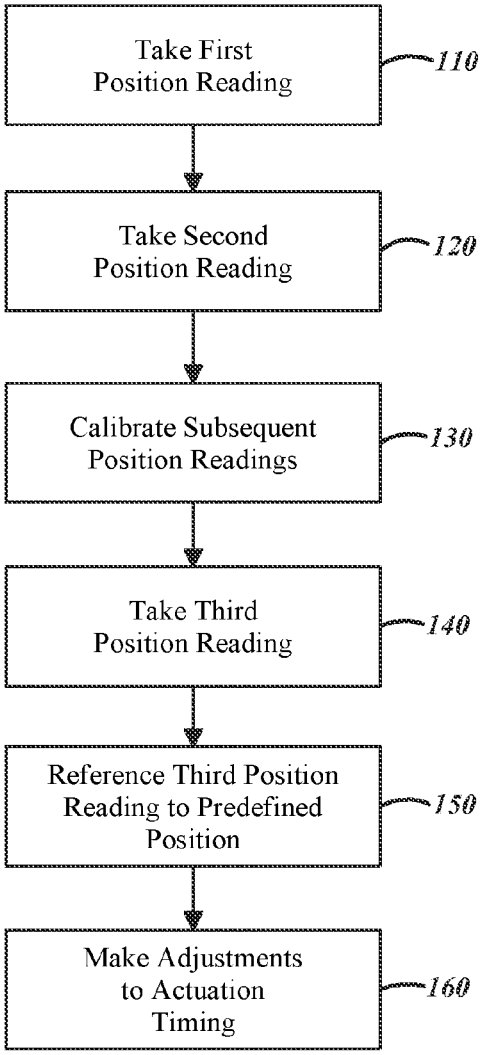
FIG. 3 is a flow chart presenting an embodiment of a method of adjusting actuation timing of valves in a piston engine via variable valve actuation assemblies.
Figure 4:
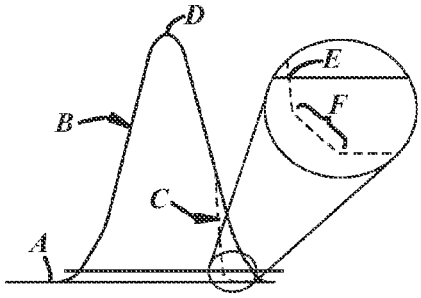
FIG. 4 is a graph plotting valve lift on the y-axis and crank angle on the x-axis.

An embodiment of the method is presented in the flow chart of FIG. 3. Other embodiments can employ more, less, and/or different steps than those set forth in the figure, and the steps need not necessarily be performed in the order described here. A step 110 involves taking a first position reading of the valves 16 when the valves 16 are at a fully closed position. The first position reading is taken by the position sensor 12 and sent to the ECU 14. FIG. 1 depicts the fully closed position where the valves 16 are fully seated and block-off associated intake and/or exhaust passages. In the example lost motion assembly 10, the cam 34 engages the rocker arm 36 with its base 38 at step 110, and the solenoid valve 20 is deactivated. Referring now to FIG. 4, the first position reading is taken at a zero lift point A on the graph. The zero lift point A represents the fully closed position. The graph of FIG. 4 plots valve actuation with valve lift displacement on the y-axis and crank angle degrees on the x-axis. The solid line B denotes actuation of the valves 16 without advancing or retarding the opening and closing movements, while the broken line C denotes an early closing valve actuation. The left side of the solid line B up to its peak marks the opening movement of the valves 16 from initial opening to full opening, and the right side of the solid line B marks the closing movement of the valves 16 from full opening to full closing. Other valve actuations not depicted in FIG. 4 include a late opening valve actuation.

Referring back to FIG. 3, a step 120 involves taking a second position reading of the valves 16, this time when the valves 16 are at a fully open position. Like the first position reading, the second position reading is taken by the position sensor 12 and sent to the ECU 14. FIG. 2 depicts the fully open position where the valves 16 permit flow through the associated intake and/or exhaust passages. In the example lost motion assembly 10, the cam 34 engages the rocker arm 36 at a peak of its lobe 40 at step 120, and the solenoid valve 20 is activated and the slave piston 26 drives the bridge 46 outward to its greatest extent. Referring again to FIG. 4, the second position reading is taken at a maximum lift point D, which represents the fully open position.

The method further includes a step 130 that involves using the first and second position readings of steps 110, 120 to calibrate subsequent position readings taken by the position sensor 12. In this sense, the first and second position readings could be considered calibration position readings. The calibration relates and references position sensor readings to physical positions of the valves 16. In the example of the variable inductance position sensor 12, a given hertz value of the sensor 12 is corresponded to a given displacement value of the valves 16 measured relative to the fully closed position of the valves 16. The calibration can occur at any time and any number of times amid the operation of the associated piston engine, and the occurrence may be dictated by the engine performance strategy set by the automobile manufacturer. For instance, initial calibration can be executed at engine start-up, and ensuing re-calibrations can be executed when the engine is warmer and at a pre-established temperature, or when the engine is at a wide-open throttle operating condition. Still, the calibration could involve other and different steps, and whether the steps 110, 120, 130 are performed at all may depend on the type of position sensor 12 put to use in the system. Since the calibration takes place after the VVA assembly 10 is installed in the associated piston engine, imprecisely manufactured and imprecisely installed components and other differences set out above are accounted for.

After calibration, if indeed executed, a step 140 involves taking a third position reading of the valves 16 via the position sensor 12. Like other position readings, the third position reading is sent to the ECU 14. The third position reading can be taken with each opening and closing phase of the valves 16 as the valves 16 continuously actuate during engine operation, or can be taken at more infrequent intervals. Further, the position sensor 12 can take the third position reading at varied points throughout a single actuation of the valves 16. The third position reading in FIG. 4, for instance, is taken at a point E amid the closing movement of the valves 16. In this example, the point E is just before a slowdown occurs to the valves 16 as the valves 16 are approaching the fully closed position. The slowdown is effected by the valve catch of the slave piston 26, and is denoted in the graph by the bracket F. In a specific example, the point E can be situated at approximately 1 millimeter (mm) to 2 mm before the fully closed position as illustrated in the enlargement of FIG. 4. Still, the third position reading could be taken at approximately 1 mm to 2 mm after the initial opening movement of the valves 16, or at another point and another displacement along the plot of FIG. 4 such as when the valves 16 are seated in their fully closed position.

Referring again to FIG. 3, a step 150 involves referencing the third position reading of step 140 to a predefined position of the valves 16. The predefined position is typically according to the engine performance strategy set by the automobile manufacturer, and serves as the expected position of the valves 16 if the valves 16 strictly conformed to the engine performance strategy. And referencing the third position reading to the predefined position may mean comparing values and examining any discrepancies between the third position reading and the predefined position. If discrepancies exist, then a step 160 is performed. The step 160 involves making adjustments to the actuation timing of the valves 16 based on the step 150. For example, if the predefined position has a value of X and the third position reading has a value of X+4°, then adjustments would be made to narrow or altogether eliminate the margin of the four degree discrepancy. The adjustments can be effected in various ways, depending on the particular type of VVA assembly in the system. In the example of the lost motion assembly 10, the scheduled activation and deactivation can be altered per the existing discrepancy. The activation can be accelerated or decelerated, the deactivation can likewise be accelerated or decelerated, or a combination of these actions can be effected. And after the adjustments are made—whatever they may be—the steps 140, 150, and 160 can be repeated. In this way, the method provides a closed-loop feedback process that more precisely controls actuation timing of the valves 16.

Furthermore, the system and method detailed in this description could be used as part of an engine diagnostic procedure in which the functionality of the VVA assemblies 10 is monitored. The system and method may detect malfunctions that occur. In the example of the lost motion assembly 10, for instance, a jammed solenoid valve 20 or a loss of pressure in the fluid-flow circuit 28 might be evidenced by an unusually large discrepancy.

The foregoing description is considered illustrative only. The terminology that is used is intended to be in the nature of words of description rather than of limitation. Many modifications and variations will readily occur to those skilled in the art in view of the description. Thus, the foregoing description is not intended to limit the invention to the embodiments described above. Accordingly the scope of the invention as defined by the appended claims.

What is claimed is:

1. A system that provides adjustable actuation timing of at least one valve (16) in a piston engine, the system comprising:

a position sensor (12) taking position readings of a valve (16) as the valve (16) actuates in the piston engine; and a variable valve actuation assembly (10) equipped at the valve (16) of the piston engine to control actuation timing of the valve (16);

wherein actuation timing of the valve (16) is adjustable based at least in part upon at least one position reading of the valve (16) taken by the position sensor (12);

wherein the position sensor (12) takes position readings of the valve (16) of a first cylinder of the piston engine;

a second position sensor (12) taking position readings of a second valve (16) of a second cylinder of the piston engine as the second valve (16) actuates at the second cylinder; and a second variable valve actuation assembly (10) equipped at the second valve (16) of the second cylinder to control actuation timing of the second valve (16);

wherein the second position sensor (12) takes a position reading of the second valve (16) before slowdown occurs adjacent a closed position, the position reading is referenced to a predefined position of the second valve (16), and actuation timing of the second valve (16) is adjustable based at least in part upon the position reading being referenced to the predefined position.

2. The system of claim 1, wherein the position sensor (12) takes a first position reading of the valve (16) when the valve (16) is at a closed position, the position sensor (12) takes a second position reading of the valve (16) when the valve (16) is at a fully open position, and wherein the first and second position readings are used for calibration to relate subsequent position sensor readings to valve position.

3. The system of claim 2, wherein the position sensor (12) takes a third position reading of the valve (16) before slowdown occurs adjacent the closed position, the third position reading is referenced to a predefined position of the valve (16), and actuation timing of the valve (16) is adjustable based at least in part upon the third position reading being referenced to the predefined position.

4. The system of claim 3, wherein, after adjustments to actuation timing have been made to the valve (16) based upon the third position reading being referenced to the predefined position, the position sensor (12) takes a fourth position reading of the valve (16) before slowdown occurs adjacent the closed position, the fourth position reading is referenced to the predefined position of the valve (16), and actuation timing of the valve (16) is adjustable based at least in part upon the fourth position reading being referenced to the predefined position.

5. The system of claim 1, wherein position readings of the valve (16) taken by the position sensor (12) are referenced to predefined positions of the valve (16) in order to monitor the functionality of the variable valve actuation assembly (10).

6. The system of claim 1, wherein the position sensor (12) is a variable inductance position sensor (12).

7. The system of claim 1, wherein the variable valve actuation assembly (10) is a lost motion assembly (10) that comprises a master piston (18), a slave piston (26), a solenoid valve (20), an accumulator (22), and a fluid-flow circuit (28), the fluid-flow circuit (28) fluidly communicating the master piston (18), slave piston (26), solenoid valve (20), and accumulator (22).

8. The system of claim 7, wherein actuation timing of the valve (16) is adjustable via activations and deactivations of the solenoid valve (20).

9. The system of claim 1, further comprising an electronic control unit (14) receiving input from the position sensor (12), and wherein actuation timing of the valve (16) is adjustable based at least in part upon the received input.

10. A method of adjusting actuation timing of at least one valve (16) in a piston engine via at least one variable valve actuation assembly (10), the method comprising:

taking a first position reading of a valve (16) in the piston engine when the valve (16) is at a closed position;

taking a second position reading of the valve (16) in the piston engine when the valve (16) is at a fully open position;

using the first and second position readings to calibrate subsequent position readings of the valve (16);

taking a third position reading of the valve (16) before slowdown occurs adjacent the closed position;

referencing the third position reading to a predefined position of the valve (16); and making adjustments to actuation timing of the valve (16), if called for, based at least in part upon the third position reading being referenced to the predefined position.

11. The method of claim 10, further comprising:

after adjustments to the actuation timing are made based upon the third position reading being referenced to the predefined position, taking a fourth position reading of the valve (16) before slowdown occurs adjacent the closed position;

referencing the fourth position reading to the predefined position of the valve (16); and making adjustments to the actuation timing of the valve (16), if called for, based at least in part upon the fourth position reading being referenced to the predefined position.

12. The method of claim 10, wherein the method of adjusting actuation timing of valves (16) in the piston engine via variable valve actuation assemblies (10) is performed on a plurality of valves (16) in the piston engine and at a plurality of cylinders in the piston engine, the plurality of valves (16) having variable valve actuation assemblies (10) equipped thereat.

13. A system that provides adjustable actuation timing of valves (16) in a piston engine, the system comprising:

a first position sensor (12) located near a first valve (16) of a first cylinder of the piston engine;

a first lost motion assembly (10) actuating the first valve (16), the first lost motion assembly (10) including a first master piston (18), a first slave piston (26), and a first solenoid valve (20);

a second position sensor (12) located near a second valve (16) of a second cylinder of the piston engine;

a second lost motion assembly (10) actuating the second valve (16), the second lost motion assembly (10) including a second master piston (18), a second slave piston (26), and a second solenoid valve (20); and an electronic control unit (14) receiving a first position reading from the first position sensor (12) of the first valve (16) before slowdown occurs adjacent a closed position, the first position reading referenced to a first predefined position, and actuation timing of the first valve (16) is adjustable via activation and deactivation of the first solenoid valve (20) based at least in part upon the first position reading being referenced to the first predefined position, and the electronic control unit (14) receiving a second position reading from the second position sensor (12) of the second valve (16) before slowdown occurs adjacent a closed position, the second position reading referenced to a second predefined position, and actuation timing of the second valve (16) is adjustable via activation and deactivation of the second solenoid valve (20) based at least in part upon the second position reading being referenced to the second predefined position.

14. The system of claim 13, wherein the first position sensor (12) takes a first calibration position reading of the first valve (16) when a base (38) of a first cam (34) engages the first master piston (18), the first position sensor (12) takes a second calibration position reading of the first valve (16) when a lobe (40) of the first cam (34) engages the first master piston (18) at a peak of the lobe (40), the first and second calibration position readings of the first valve (16) used to relate subsequent position readings to positions of the first valve (16), and the second position sensor (12) takes a first calibration position reading of the second valve (16) when a base (38) of a second cam (34) engages the second master piston (18), the second position sensor (12) takes a second calibration position reading of the second valve (16) when a lobe (40) of the second cam (34) engages the second master piston (18) at a peak of the lobe (40), the first and second calibration position readings of the second valve (16) used to relate subsequent position readings to positions of the second valve (16).

* * * * *